US006357237B1

(12) United States Patent
Candy et al.

(10) Patent No.: US 6,357,237 B1
(45) Date of Patent: Mar. 19, 2002

(54) FUEL INJECTION ASSEMBLY FOR GAS TURBINE ENGINE COMBUSTOR

(75) Inventors: Anthony J. Candy, Fairfield; Christopher C. Glynn, Hamilton; John E. Barrett, West Chester, all of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/398,558

(22) Filed: Sep. 17, 1999

Related U.S. Application Data

(60) Provisional application No. 60/103,651, filed on Oct. 9, 1998.

(51) Int. Cl.[7] ..... F02C 1/00; F02G 3/00

(52) U.S. Cl. ..... 60/737

(58) Field of Search ..... 60/733, 746, 747, 60/740, 39.83, 742, 261, 738

(56) References Cited

U.S. PATENT DOCUMENTS

| | | | | |
|---|---|---|---|---|
| 4,854,127 A | * | 8/1989 | Vinson et al. | 60/748 |
| 5,444,982 A | | 8/1995 | Heberling et al. | 60/737 |
| 5,540,056 A | | 7/1996 | Heberling et al. | 60/737 |
| 5,577,386 A | * | 11/1996 | Alary et al. | 60/742 |
| 5,596,873 A | | 1/1997 | Joshi et al. | 60/738 |
| 5,619,855 A | | 4/1997 | Burrus | 60/736 |
| 5,791,148 A | | 8/1998 | Burrus | 60/752 |

FOREIGN PATENT DOCUMENTS

| | | |
|---|---|---|
| EP | 0689007 A | 12/1995 |
| EP | 841517 A2 | 8/1997 |

OTHER PUBLICATIONS

"HSCT Computer Model Takes Shape at NASA," pp. 68–76, by James Ott, Hampton, VA, in Aviation Week & Space Technology, Oct. 13, 1997.

* cited by examiner

*Primary Examiner*—Charles G. Freay
*Assistant Examiner*—William H Rodriguez
(74) *Attorney, Agent, or Firm*—Andrew C. Hess; William Scott Andes

(57) ABSTRACT

A fuel injection assembly for a gas turbine engine combustor, including at least one fuel stem, a plurality of concentrically disposed tubes positioned within each fuel stem, wherein a cooling supply flow passage, a cooling return flow passage, and a tip fuel flow passage are defined thereby, and at least one fuel tip assembly connected to each fuel stem so as to be in flow communication with the flow passages, wherein an active cooling circuit for each fuel stem and fuel tip assembly is maintained by providing all active fuel through the cooling supply flow passage and the cooling return flow passage during each stage of combustor operation. The fuel flowing through the active cooling circuit is then collected so that a predetermined portion thereof is provided to the tip fuel flow passage for injection by the fuel tip assembly.

17 Claims, 5 Drawing Sheets

FUEL INJECTION ASSEMBLY FOR GAS TURBINE ENGINE COMBUSTOR

Benefit of Provisional Application No. 60/103,651, filed on Oct. 9, 1998, is hereby claimed.

This invention was made with Government support under contract number NAS3-27235 awarded by NASA. The U.S. Government may have rights in this invention.

BACKGROUND OF THE INVENTION

The present invention relates generally to combustors in gas turbine engines and, in particular, to a fuel injection assembly for a gas turbine engine combustor having mixing tubes which are widely dispersed throughout the main combustor dome region.

It will be appreciated that emissions are a primary concern in the operation of gas turbine engines, particularly with respect to the impact on the ozone layer by nitrous oxides (NOx), carbon monoxide (CO), and hydrocarbons. In the case of supersonic commercial transport aircraft flying at high altitudes, current subsonic aircraft technology is not applicable given the detrimental effects on the stratospheric ozone. Accordingly, new fuel injection and mixing techniques have been and continue to be developed in order to provide ultra-low NOx at all engine operating conditions.

In response to such emissions concerns, a new combustor has been developed and is discussed in a parent application entitled "Multi-Stage Radial Axial Gas Turbine Engine Combustor," which is filed concurrently herewith by the assignee of the present invention, has Ser. No. 09/398,577, and is hereby incorporated by reference. It will be seen therein that a key component found to provide extremely low levels of NOx at moderate to high power conditions for aircraft engines was the use of a series of simple mixing tubes as the main fuel injection source. A related patent application entitled "Fuel Flow Control System," owned by the assignee of the present invention and having Ser. No. 09/366,510, describes how a control system determines which mixing tubes are to be supplied with fuel in greater detail and is hereby incorporated by reference.

Still, fuel must be transported from a fuel supply controlled by the system in the '510 patent application into the mixing tubes disclosed in the combustor of the '577 patent application. It will be appreciated that the mixing tubes are preferably arranged in a plurality of rows and columns. Because the mixing tubes are widely dispersed throughout the main combustor dome region, significant weight, thermal management and structural integrity challenges are presented. As is typical for all flight quality engine hardware, the fuel injection assembly must be as light as possible to minimize engine weight. The thermal management challenge for the fuel injection assembly stems from the extensive fuel-wetted surface area thereof immersed within the high temperature compressor discharge environment, which increases the potential for coke residues to form a partial or full blockage in the fuel passages.

Naturally, the injector tips of the fuel injection assembly must be accurately maintained in position throughout all engine power settings to obtain acceptable system emissions performance. Because the injection sites are widely dispersed, however, maintaining structural integrity of the fuel injection assembly in the hostile dynamic environment of the compressor discharge region, which contains high intensity broadband acoustic excitation, is a particular challenge. Thus, the fuel injection assembly must incorporate sufficient rigidity and damping capability to survive and function in the lightest weight configuration possible.

In light of the foregoing, it would be desirable for a fuel injection assembly to be developed which can provide fuel to a plurality of mixing tubes which are widely dispersed in a gas turbine engine combustor. It would also be desirable for such fuel injection assembly to include continuous active cooling for the fuel stem and injector tip whether fuel is injected into such mixing tubes or not. Further, it would be desirable for the fuel injection assembly to reflect a concern for weight, airflow blockage to the combustor dome region, and ease of removal for maintenance.

BRIEF SUMMARY OF THE INVENTION

In an exemplary embodiment of the invention, a fuel injection assembly for a gas turbine engine combustor is disclosed as including at least one fuel stem, a plurality of concentrically disposed tubes positioned within each fuel stem, wherein a cooling supply flow passage, a cooling return flow passage, and a tip fuel flow passage are defined thereby, and at least one fuel tip assembly connected to each fuel stem so as to be in flow communication with the flow passages, wherein an active cooling circuit for each fuel stem and fuel tip assembly is maintained by providing all active fuel through the cooling supply flow passage and the cooling return flow passage during each stage of combustor operation. The fuel flowing through the active cooling circuit is then collected so that a predetermined portion thereof is provided to the tip fuel flow passage for injection by the fuel tip assembly.

DETAILED DESCRIPTION OF THE INVENTION

Figure 1:
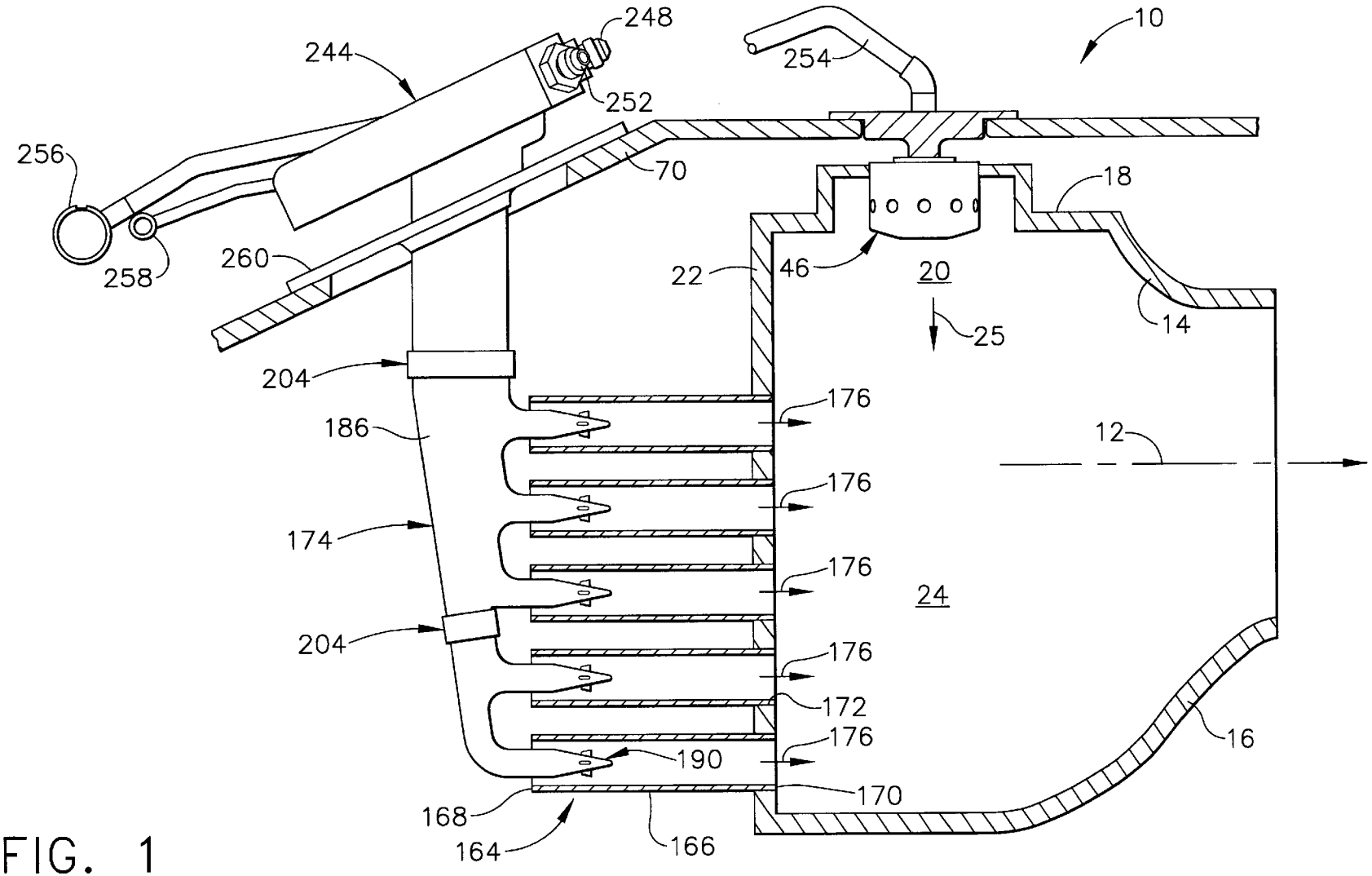
FIG. 1 is a schematic longitudinal cross-sectional view of a gas turbine engine combustor including a fuel injection assembly in accordance with the present invention.

Referring now to the drawings in detail, wherein identical numerals indicate the same elements throughout the figures, FIG. 1 depicts a multi-stage radial axial (MRA) gas turbine engine combustor identified generally by reference numeral 10. It will be understood that combustor 10 is in accordance with a combustor disclosed in a patent application entitled "Multi-Stage Radial Axial Gas Turbine Engine Combustor," having Ser. No. 09/398,577, which is file concurrently herewith and hereby incorporated by reference. As seen therein, combustor 10 has a longitudinal axis 12 extending therethrough and includes an outer liner 14, an inner liner 16, a first or pilot dome 18 positioned immediately upstream of outer liner 14 to form a first combustion zone 20 radially oriented to longitudinal axis 12, and a dome plate 22 which is connected to first dome 18 at an outer portion and to inner liner 16 at an inner portion. In this way, a second or main combustion zone 24 is defined by dome plate 22, outer liner 14 and inner liner 16 which is located substantially perpendicular to first combustion zone 20. Of course, it will be appreciated that first dome 18 is positioned axially downstream of dome plate 22 as indicated by a radial axis 25 extending through first dome 18.

As indicated in the '577 patent application, a mixture of fuel and air is provided axially through dome plate 22 into second combustion zone 24 only during moderate and high operation levels. This is preferably accomplished by a plurality of fuel air mixers 164 positioned upstream of dome plate 22. It will be appreciated from FIG. 1 that a plurality of substantially linear tubes 166 are spaced radially and circumferentially around dome plate 22 so as to be arranged in rows and columns, respectively. Each tube 166 has an upstream end 168 and a downstream end 170, wherein downstream end 170 is positioned in alignment with an opening 172 in dome plate 22 and a fuel injection assembly 174 in accordance with the present invention is positioned so as to provide fuel to tube upstream end 168. In this way, flexibility is built into combustor 10 whereby designated rows and/or columns of fuel air mixers may be provided fuel. It will be appreciated that the fuel air mixtures flowing into second combustion zone 24, represented by arrows 176, are substantially parallel to longitudinal axis 12 and unswirled. Of course, fuel injection assemblies 174 are in flow communication with a fuel supply as will be discussed in greater detail hereinafter.

In operation, combustor 10 of the present invention has a multi-stage function in which first dome 18 acts as a pilot. Accordingly, fuel is supplied to first dome 18 during all phases of combustor operation. It is noted that this is particularly important during low power conditions (e.g., idle cycles and landing-takeoff operations), as fuel is not provided to fuel air mixers 164 during such time. For moderate to high power conditions, fuel is provided to at least some of fuel air mixers 164 so that fuel air mixture 176 is injected into second combustion zone 24. Since combustor 10 involves multiple stages of operation, has a radially oriented dome 18, and an axial dome plate 22, it is known as a multi-stage radial axial (MRA) combustor.

Figure 2:
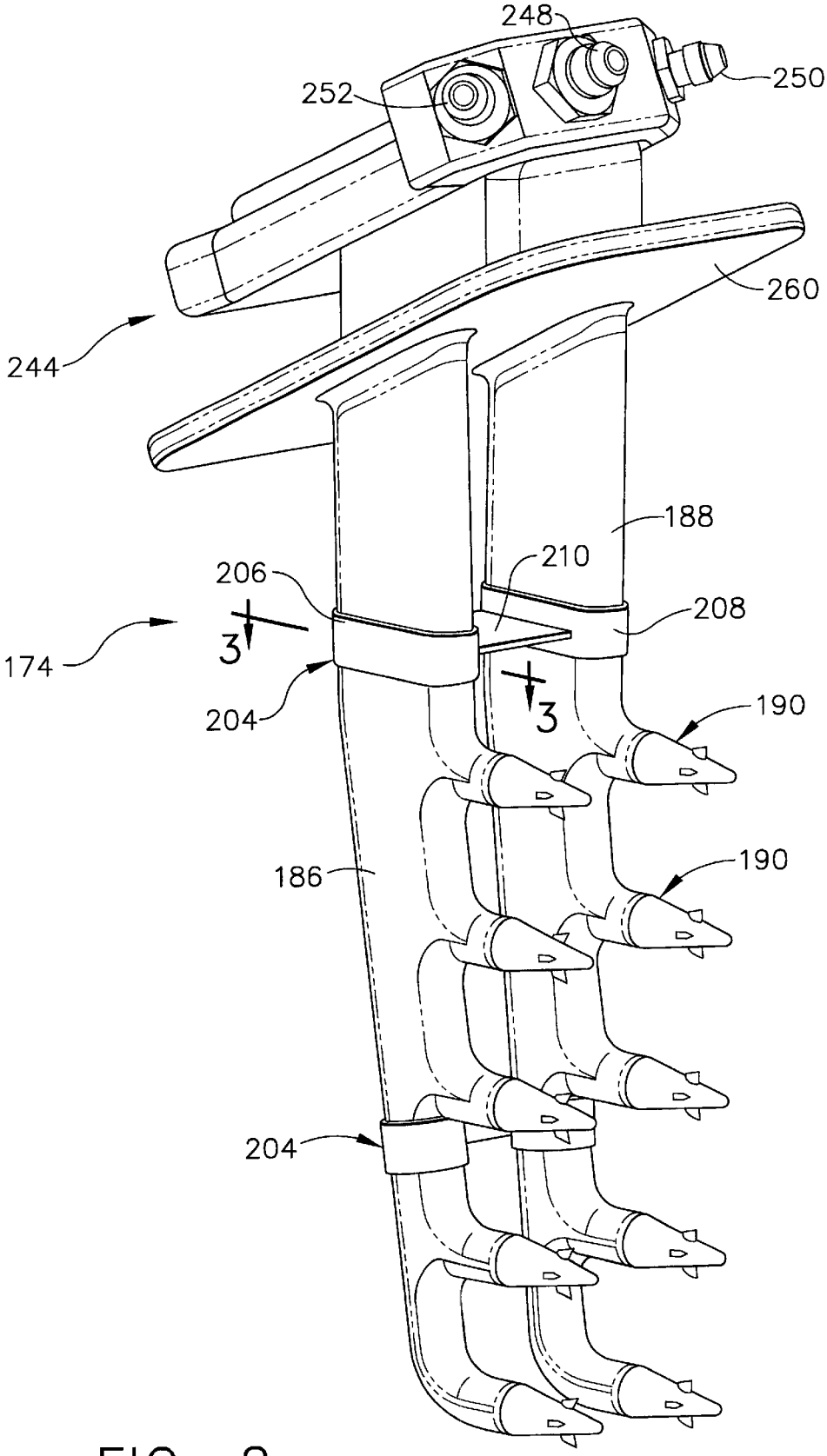
FIG. 2 is a perspective view of the fuel injection assembly depicted in FIG. 1.
Figure 3:
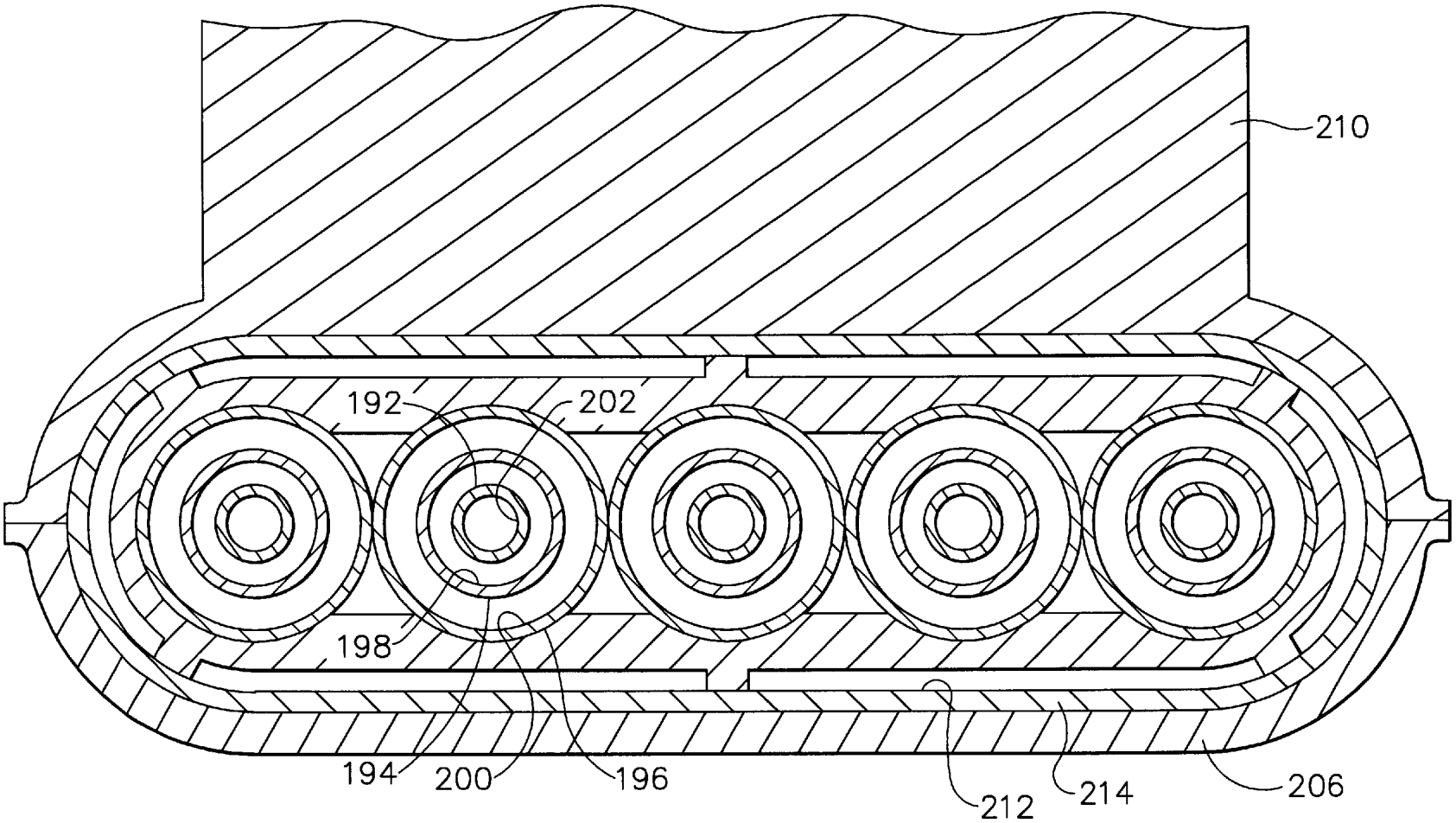
FIG. 3 is a partial cross-sectional view of the fuel injection assembly depicted in FIGS. 1 and 2 taken along line 3—3 of FIG. 2.

With respect to the fuel injection assemblies 174, it will be seen from FIG. 2 that at least one fuel stem, and preferably a pair of fuel stems 186 and 188, are provided which extend substantially radially with respect to longitudinal axis 12. At least one fuel tip assembly 190 is connected to fuel stems 186 and 188 for injecting fuel into a corresponding mixing tube 166, with the number of fuel tip assemblies, as well as the spacing therebetween, being dependent upon the arrangement of mixing tubes 166. Each fuel stem 186 and 188 includes a plurality of concentrically disposed tubes therein known as tip supply tube 192, insulating tube 194, and outer tube 196. Such tubes define a cooling supply flow passage 198, a cooling return flow passage 200, and a tip fuel flow passage 202 (see FIGS. 3–5). It will be noted that cooling supply flow passage 198 is preferably the middle annulus of the triple-concentric tube configuration in order to present the coolest fuel to tip assembly 190 and maximize cooling in this region. Moreover, utilizing cooling return passage 200 as the outer annulus assists in reducing heat transfer to the fuel on the return trip by raising the bulk temperature of the cooling fluid therein. This also has the effect of providing cooling to fuel stems 186 and 188 after cooling of fuel tip assemblies 190 has taken place. Thus, it will be understood that tip fuel flow passage 202 is the innermost passage of the triple-concentric tube configuration which supplies fuel to fuel tip assemblies 190 for injection into mixing tubes 166.

Figure 5:
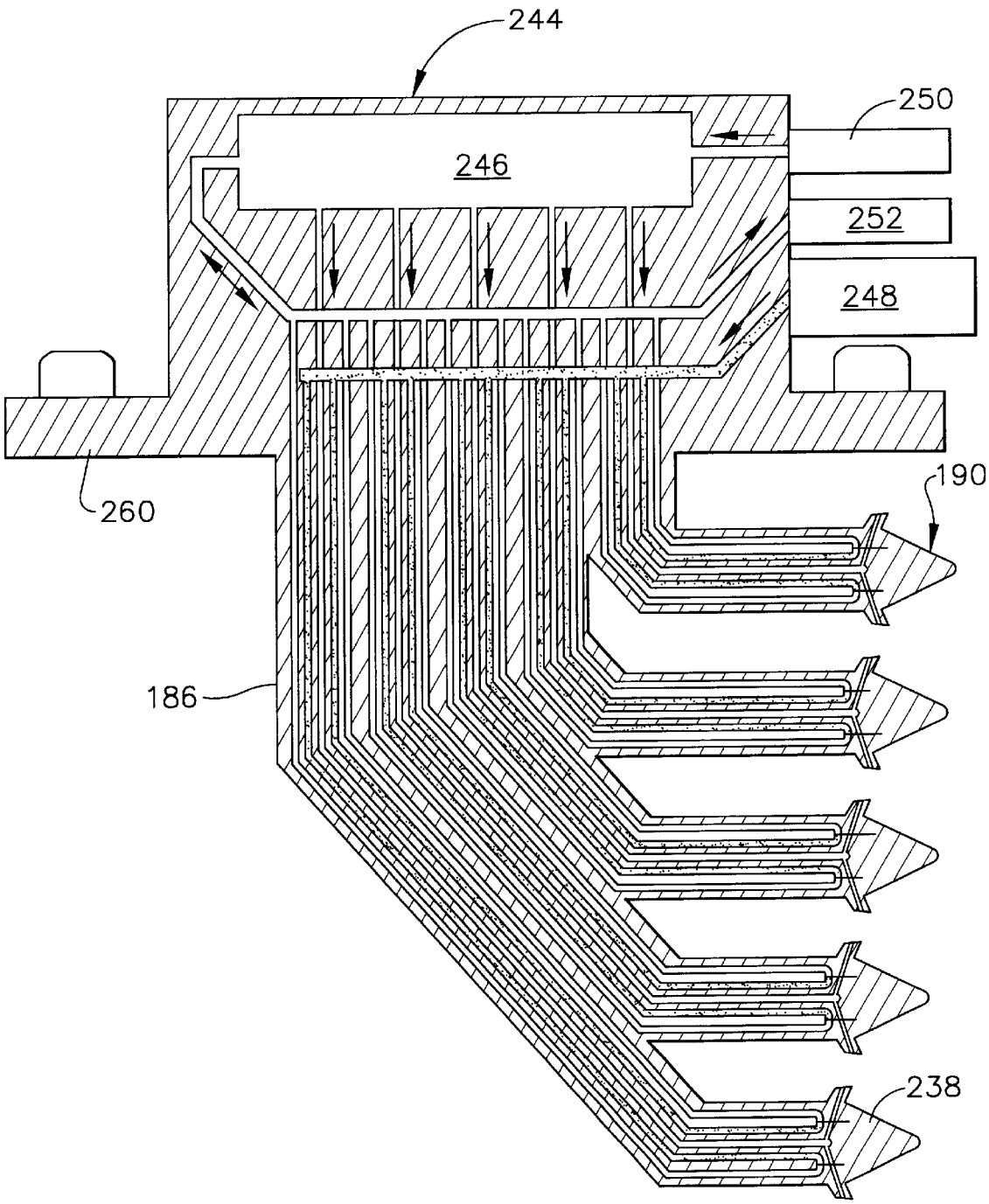

As best seen in FIG. 5, each fuel tip assembly 190 preferably has an independent set of concentrically disposed tubes 192, 194 and 196 associated therewith (to form a so-called "tube bundle" in fuel stems 186 and 188) so that fuel is supplied to each fuel tip assembly 190 or not based on the level of combustor operation desired. It will be remembered that fuel air mixers 164 of only designated rows or columns, for example, may have fuel supplied thereto. One example of how this is accomplished is disclosed in the '510 patent application incorporated hereinabove by reference. While provision of fuel through tip fuel passage 202 for each set of concentrically disposed tubes does not occur under all circumstances, it is preferred for fuel to be continuously circulated through all cooling supply and cooling return flow passages 198 and 200, respectively. In this way, an active cooling circuit is provided for each fuel stem 186/188 and fuel tip assembly 190 during all stages of combustor operation, thereby assisting in the prevention of fuel being coked (and potential blockage in all flow passages stemming therefrom).

As stated above, it is preferred that a pair of fuel stems 186 and 188 be coupled together so as to reduce airflow blockage in the combustor dome region and facilitate maintenance removal or replacement of fuel injection assemblies 174 from the combustor casing. Additionally, it has been found that the paired configuration is a more structurally rigid and dynamically stable design. A preferred manner of coupling fuel stems 186 and 188 is by means of one or more cross brace assemblies 204 depicted in FIG. 2. It will be seen that each cross brace assembly 204 includes a first portion 206 wrapped around a first fuel stem 186, a second portion 208 wrapped around a second fuel stem 188, and a third portion 210 connecting first and second portions 206 and 208, respectively. While third portion 210 is shown as a straight beam, it will be appreciated that this may have any design to accommodate a change in stiffness and/or damping as required. It is further noted that such cross brace assemblies 204 preferably serve as the locations of the bundling feature for the set of concentric tubes.

In conjunction with each cross brace assembly 204, a lugged spacer member 212 is preferably positioned between the bundle of concentrically disposed tubes and a heat shield 214 (see FIG. 3) preferably wrapped around the tube bundle for thermal protection. Not only does lugged spacer member 212 secure each tube bundle together, but it also transmits structural loads to cross brace assembly 204 while minimizing contact with heat shield 214. Thus, lugged spacer member 212 serves to reduce the heat transfer between the relatively cool tubes and the hot heat shield 214 and therefore the cooling burden on the active cooling system.

It will further be appreciated that concentric tubes 192, 194 and 196 are conventional straight tubes which are assembled together and mechanically formed into the final configuration using conventional manufacturing processes. Nevertheless, because fuel stems 186 and 188 include certain non-linear portions where tubes 192, 194 and 196 are bent (i.e., where fuel stems 186 and 188 are configured to connect to tip assemblies 190 so as to be in substantially parallel relation to longitudinal axis 12), a small gauge wire or other similar means is wrapped around each set of tubes at such location to avoid contact between the tubes and minimize restriction of flow passages 198, 200 and 202. The wire is able to accomplish this function by maintaining a minimum gap between the tubes in this non-linear region as they are bent.

Figure 4:
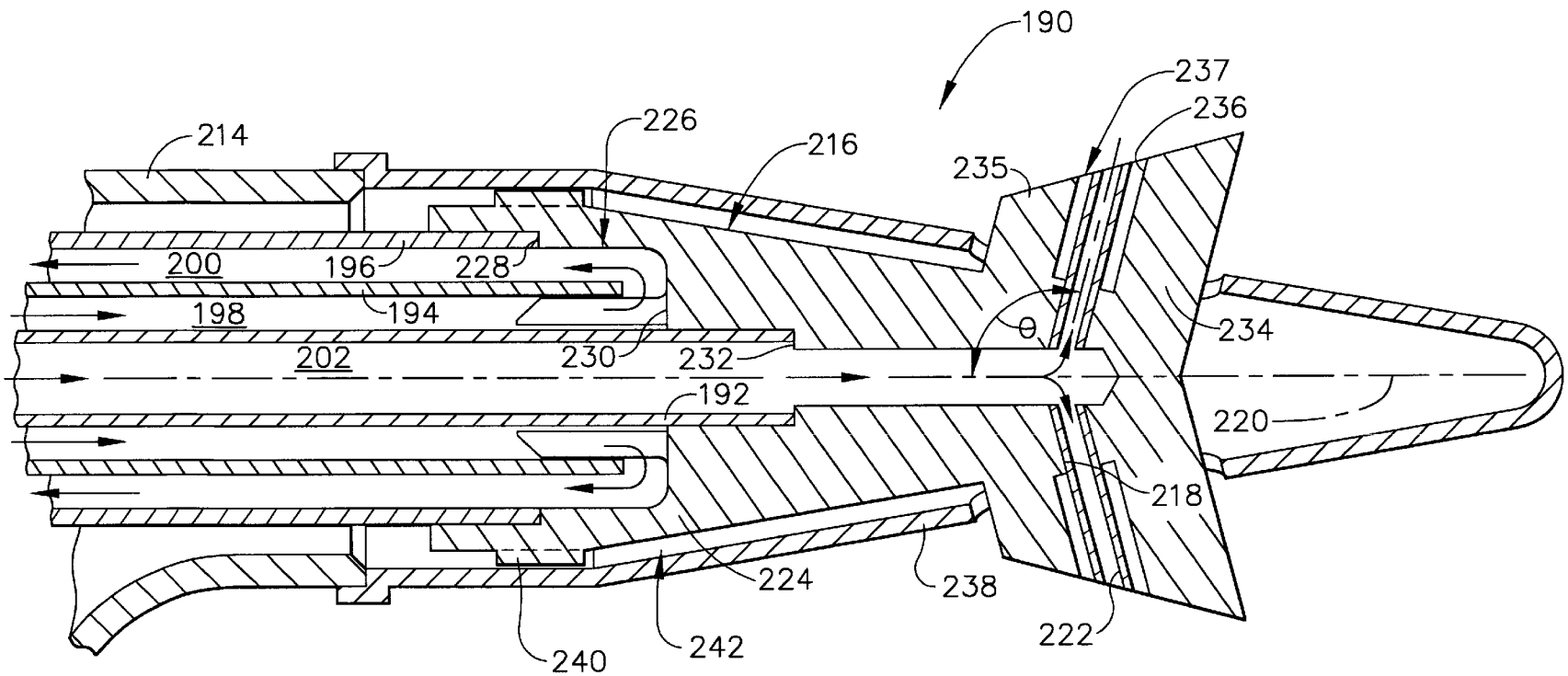
FIG. 4 is a partial longitudinal cross-sectional view of the injector tip portion of the fuel injector assembly depicted in FIGS. 1–3; and, FIG. 5 is a schematic longitudinal cross-sectional view of the fuel injector assembly depicted in FIG. 2.

With regard to each fuel tip assembly 190, it will be seen in FIG. 4 that a fuel injector tip body 216 is included having a plurality of injection passages 218 formed therein which are in flow communication with tip fuel flow passage 202.

Injection passages 218 generally extend radially with respect to an axis 220 through tip fuel flow passage 202 and optimally are oriented at an obtuse angle θ with respect to axis 220 so as to inject fuel in mixing tube 166 at a slight downstream orientation. Insulated fuel injection tubes 222 are preferably positioned in each injection passage 218 in order to thermally isolate the injected fuel flow from tip body 216.

It will be noted that tip body 216 is substantially frusto-conical in shape and has a cavity 226 formed in a first end 224 thereof that is configured to receive concentric tubes 192, 194 and 196. More specifically, cavity 226 includes a first step 228 which is connected to outer tube 196, a second step 230 which is spaced from the end of insulating tube 194 so that cooling supply flow passage 198 is in flow communication with cooling return flow passage 200, and a third step 232 which is connected to tip supply tube 192.

A second end 234 of tip body 216 located downstream of first end 224, while generally conforming with the frusto-conical shape of tip body 216, further includes a plurality of local aerodynamically-shaped extensions 235 which extend radially outward from the surface of tip body 216 with respect to axis 220. Extensions 235 are circumferentially spaced about tip body second end 234 and include injection passages 218 formed therein. In order to also accommodate insulated mixing tubes 222, it will be appreciated that each extension 235 has a cavity 236 incorporated therein. In this way, fuel is better introduced into the air stream of mixing tube 166 while providing additional thermal protections to insulated mixing tribes 222 by means of an air gap 237.

Fuel tip assembly 190 further includes a heat shield 238 which encircles tip body 216 in a substantially conical design and is welded or otherwise attached to heat shield 214 so as to provide continuous thermal protection thereto. It will also be seen that heat shield 238 provides an aerodynamic faring to reduce separation of airflow at tip body 216 and encourage proper mixing of the fuel and air after discharge into mixing tube 166. Offset lugs 240 are provided to set an air gap 242 between heat shield 238 and tip body 216, as well as enhance mechanical rigidity of tip assembly 190 while minimizing contact between heat shield 238 and tip body 216.

Fuel injection assembly 174 is coupled at the end opposite fuel tip assemblies 190 to a valve body 244 (see FIGS. 1, 2 and 5, where a cover to valve body 244 has been removed for clarity). Valve body 244 houses a multi-stage servo valve 246 and includes a first connection 248 for a main manifold inlet, a second connection 250 for a staging manifold inlet, and a third connection 252 with a pilot fuel supply tube 254. It will be appreciated that first and second connections 248 and 250, respectively, are in fluid communication with a main fuel manifold 256 and a staging signal manifold 258. Valve body 244 also preferably includes a flange portion 260 incorporated therewith by which fuel injection assembly 174 is connected to combustor casing 70 by means of bolts or other mechanical connecting means. Fuel stems 186 and 188 are attached to valve body 244 by means of brazing or other similar attachment.

In operation, it will be seen that metered fuel flow (including both the pilot and main injector flow) is utilized to circulate cooling flow through fuel stems 186 and 188 and the fuel tip assemblies 190. The fuel flow enters valve body 244 through main manifold inlet connection 248 and is distributed to all fuel stems 186, 188 through the middle annulus (i.e., cooling supply flow passage 198) of each triple concentric tube configuration. This cooling flow may be distributed equally to all fuel stems or it can be biased to present a higher level of cooling flows to those stems or fuel tip assemblies requiring increased cooling by means of a simple trimming device or orifice in the fuel stems. The cooling flow is then circulated through cooling supply and return flow passages 198 and 200, respectively, back to valve body 244.

Once in the valve body 244, the active fuel circulated through the active cooling circuit is collected and routed either to staging valve 246 or pilot injector supply tube 254 depending on the position of staging valve 246. It will be appreciated from the '510 patent application that the staging valve position is controlled by setting the staging servo manifold pressure relative to the main manifold pressure by the main engine control. In this way, active fuel is supplied (or not) to tip assemblies 190 through tip fuel flow passages 202 and injected into mixing tubes 166 through injection passages 218 and insulated tubes 222. In the cases where no main fuel flow is required (e.g., at engine idle), it will be appreciated that the active fuel flow through the active cooling circuit is provided by the pilot injector flow alone. Thus, cooling flow is provided to fuel stems 186 and 188, as well as tip assemblies 190, at all stages of combustor operation.

One benefit of having multiple injection sites (i.e., a plurality of fuel injection tubes 222 from a common source) is the facilitation of natural or self purging of fuel in the passages of such tubes 222. It will be understood that when a given tip assembly 190 is staged or shutdown during engine operation, natural static pressure variations, which may be enhanced by strategic orientation of fuel injection tubes 222 relative to fuel stem wake regions, cause air to flow from high to low pressure regions. Thus, any stagnant fuel in fuel injection tubes 222, and to a lesser extent tip fuel flow passage 202, is evacuated. Fuel which remains in tip fuel flow passage 202 is of course still thermally protected by the active cooling feature of fuel injection assembly 174. This self purging action eliminates the need for active inert gas purging of tip fuel flow passage 202 to avoid coking formation in stagnant fuel lines.

Having shown and described the preferred embodiment of the present invention, further adaptations of the fuel injection assembly can be accomplished by appropriate modifications by one of ordinary skill in the art without departing from the scope of the invention.

What is claimed is:

1. A fuel injection assembly for a gas turbine engine combustor, comprising:

(a) a pair of fuel stems positioned in spaced adjacent manner;

(b) a plurality of fuel tip assemblies connected to each said fuel stem;

(c) a bundle of concentrically disposed tubes positioned in each said fuel stem to define an independent cooling supply flow passage, cooling return flow passage, and tip fuel flow passage in flow communication with each said fuel tip assembly; and (d) at least one cross brace member coupling said fuel stems.

2. A fuel injection assembly for a gas turbine engine combustor, comprising:

(a) at least one fuel stem;

(b) a plurality of fuel tip assemblies connected to each said fuel stem;

(c) a bundle of concentrically disposed tubes positioned in each said fuel stem to define an independent cooling supply flow passage, cooling return flow passage, and tip fuel flow passage in flow communication with each said fuel tip assembly;

(d) a valve body connected to each said fuel stem for housing a staging valve which controls the amount of active fuel circulated through said tubes, said valve body including a first inlet connection in flow communication with a main manifold, a second inlet connection in flow communication with a staging manifold, and a third connection in flow communication with a pilot supply tube.

3. The fuel injection assembly of claim 2, further comprising a flange portion integrated with said valve body for coupling said fuel injection assembly to a casing for said combustor.

4. A fuel injection assembly for a gas turbine engine combustor, comprising:

(a) at least one fuel stem;

(b) a plurality of fuel tip assemblies connected to each said fuel stem; and (c) a bundle of concentrically disposed tubes positioned in each said fuel stem to define an independent cooling supply flow passage, cooling return flow passage, and tip fuel flow passage in flow communication with each said fuel tip assembly;

wherein said fuel tip flow passage is an inner passage through said concentrically disposed tubes.

5. The fuel injection assembly of claim 4, wherein said cooling supply flow passage is a middle annular passage through said concentrically disposed tubes located between said fuel tip flow passage and said cooling return flow passage.

6. The fuel injection assembly of claim 5, wherein said cooling return flow passage is an outer annular passage through said concentrically disposed tubes.

7. The fuel injection assembly of claim 4, further comprising a heat shield positioned around said bundle of concentrically disposed tubes.

8. The fuel injection assembly of claim 4, said fuel stem including at least one non-linear portion, wherein a spacer is provided between each set of said concentrically disposed tubes in said non-linear fuel stem portions.

9. The fuel injection assembly of claim 7, further comprising a lugged spacer member positioned between said concentrically disposed tube set and said heat shield.

10. A fuel injection assembly for a gas turbine engine combustor, comprising:

(a) at least one fuel stem;

(b) a bundle of concentrically disposed tubes positioned in each said fuel stem to define an independent cooling supply flow passage, cooling return flow passage, and tip fuel flow passage; and (c) a plurality of fuel tip assemblies connected to each said fuel stem in flow communication with said passages, each said fuel tip assembly further comprising a fuel injector tip body having a plurality of injection passages in flow communication with said tip fuel flow passage, wherein said injection passages are oriented substantially radially to an axis through said tip fuel flow passage, said tip body further comprising:

(1) a first end connected to said fuel stem so as to provide flow communication between said cooling supply and cooling return flow passages; and (2) a second end having said fuel injection passages formed therein, said second tip body end including a plurality of extensions extending radially outward therefrom, each said extension including a cavity therein so as to permit said injection tubes to extend therethrough.

11. The fuel injection assembly of claim 10, further comprising a fuel injection tube positioned in each said injection passage.

12. The fuel injection assembly of claim 10, further comprising a heat shield positioned around said fuel injector tip body.

13. The fuel injection assembly of claim 12, wherein said heat shield is substantially conical in shape.

14. The fuel injection assembly of claim 12, further comprising a lug positioned between said fuel injector tip body and said heat shield so as to control an air gap therebetween.

15. The fuel injection assembly of claim 2, wherein the amount of active fuel provided to said cooling supply passages by said valve body is dependent upon a controlled amount of fuel to be injected into said combustor.

16. The fuel injection assembly of claim 2, wherein the active fuel flowing through each said cooling return flow passage is collected by said valve body so that a predetermined portion thereof is provided to each said tip fuel flow passage for injection by each said tip fuel assembly.

17. The fuel injection assembly of claim 15, wherein said valve body provides at least a predetermined amount of said active fuel to said cooling supply passages during combustor operation.

* * * * *